US011462342B2

(12) United States Patent
Stack et al.

(10) Patent No.: US 11,462,342 B2
(45) Date of Patent: Oct. 4, 2022

(54) CABLE HARNESS ASSEMBLY WITH A SHIELDED TWISTED PAIR CABLE

(71) Applicant: TE Connectivity Services GmbH, Schaffhausen (CH)

(72) Inventors: Daniel Stack, Winston-Salem, NC (US); Sterling A. Vaden, Winston-Salem, NC (US)

(73) Assignee: TE CONNECTIVITY SOLUTIONS GMBH, Schaffhausen (CH)

( * ) Notice: Subject to any disclaimer, the term of this patent is extended or adjusted under 35 U.S.C. 154(b) by 48 days.

(21) Appl. No.: 17/063,998

(22) Filed: Oct. 6, 2020

(65) Prior Publication Data

US 2022/0108817 A1 Apr. 7, 2022

(51) Int. Cl.

| | |
|---|---|
| ***H01B 11/08*** | (2006.01) |
| ***H01R 13/6581*** | (2011.01) |
| ***H01B 7/00*** | (2006.01) |
| ***H01R 9/05*** | (2006.01) |

(52) U.S. Cl.

CPC ..... *H01B 7/0045* (2013.01); *H01B 11/08* (2013.01); *H01R 9/0518* (2013.01); *H01R 13/6581* (2013.01)

(58) Field of Classification Search

CPC .... H01B 7/0045; H01B 11/08; H01R 9/0518; H01R 13/6581

USPC ..... 174/72 A

See application file for complete search history.

(56) References Cited

U.S. PATENT DOCUMENTS

| | | | | |
|---|---|---|---|---|
| 4,634,208 | A * | 1/1987 | Hall | H01R 13/6594 439/607.51 |
| 5,643,009 | A | 7/1997 | Dinkel et al. | |
| 6,007,370 | A | 12/1999 | Langridge | |
| 6,257,920 | B1 * | 7/2001 | Finona | H01R 13/5808 439/455 |
| 6,670,880 | B1 * | 12/2003 | Hall | H01R 13/533 336/15 |
| 7,264,402 | B2 | 9/2007 | Theuerkorn et al. | |
| 7,494,377 | B2 | 2/2009 | Yohn et al. | |
| 9,257,796 | B1 * | 2/2016 | Dang | H01R 13/6463 |
| 9,899,760 | B2 * | 2/2018 | Kleymann | H01R 13/5837 |
| 2005/0221673 | A1 * | 10/2005 | Myer | H01R 43/18 439/607.01 |
| 2012/0171884 | A1 | 7/2012 | Dang | |
| 2018/0026402 | A1 | 1/2018 | Zebhauser et al. | |

FOREIGN PATENT DOCUMENTS

DE 102019128172 A1 6/2020

OTHER PUBLICATIONS

Partial European Search Report, European Application No. 21200725.6-1201, European Filing Date, Feb. 22, 2022.

* cited by examiner

*Primary Examiner* — Timothy J Thompson
*Assistant Examiner* — Michael F McAllister

(57) ABSTRACT

A cable harness assembly includes a cable having a pair of wires and a connector assembly including an inner ferrule formed of a conductive material. Each of the wires has a conductor and a insulation disposed around the conductor. The pair of wires have a twisted region and an untwisted region. The inner ferrule has a cable passageway extending through the inner ferrule and a separator disposed within the cable passageway. The untwisted region is disposed in the inner ferrule and the separator is disposed between the wires in the untwisted region.

29 Claims, 9 Drawing Sheets

CABLE HARNESS ASSEMBLY WITH A SHIELDED TWISTED PAIR CABLE

FIELD OF THE INVENTION

The present invention relates to a cable harness assembly and, more particularly, to a cable harness assembly with a shielded twisted pair cable.

BACKGROUND

A connector assembly is secured to a shielded twisted pair cable in order to permit separable electrical connection of the shielded twisted pair cable to other electrical elements. The connector assembly often includes a housing and a ferrule that is used to prevent movement of the cable with respect to the housing. The ferrule, however, is often the only element that secures both the components of the housing together and the cable to the housing, increasing difficulty in assembly and in servicing a cable harness assembly formed by the connector assembly and the cable. Further, the shielded twisted pair cable is untwisted inside the housing to connect to the other electrical elements, complicating control of the impedance of the cable.

SUMMARY

A cable harness assembly includes a cable having a pair of wires and a connector assembly including an inner ferrule formed of a conductive material. Each of the wires has a conductor and a insulation disposed around the conductor. The pair of wires have a twisted region and an untwisted region. The inner ferrule has a cable passageway extending through the inner ferrule and a separator disposed within the cable passageway. The untwisted region is disposed in the inner ferrule and the separator is disposed between the wires in the untwisted region.

BRIEF DESCRIPTION OF THE DRAWINGS

The invention will now be described by way of example with reference to the accompanying Figures, of which.

DETAILED DESCRIPTION OF THE EMBODIMENTS

Figure 1:
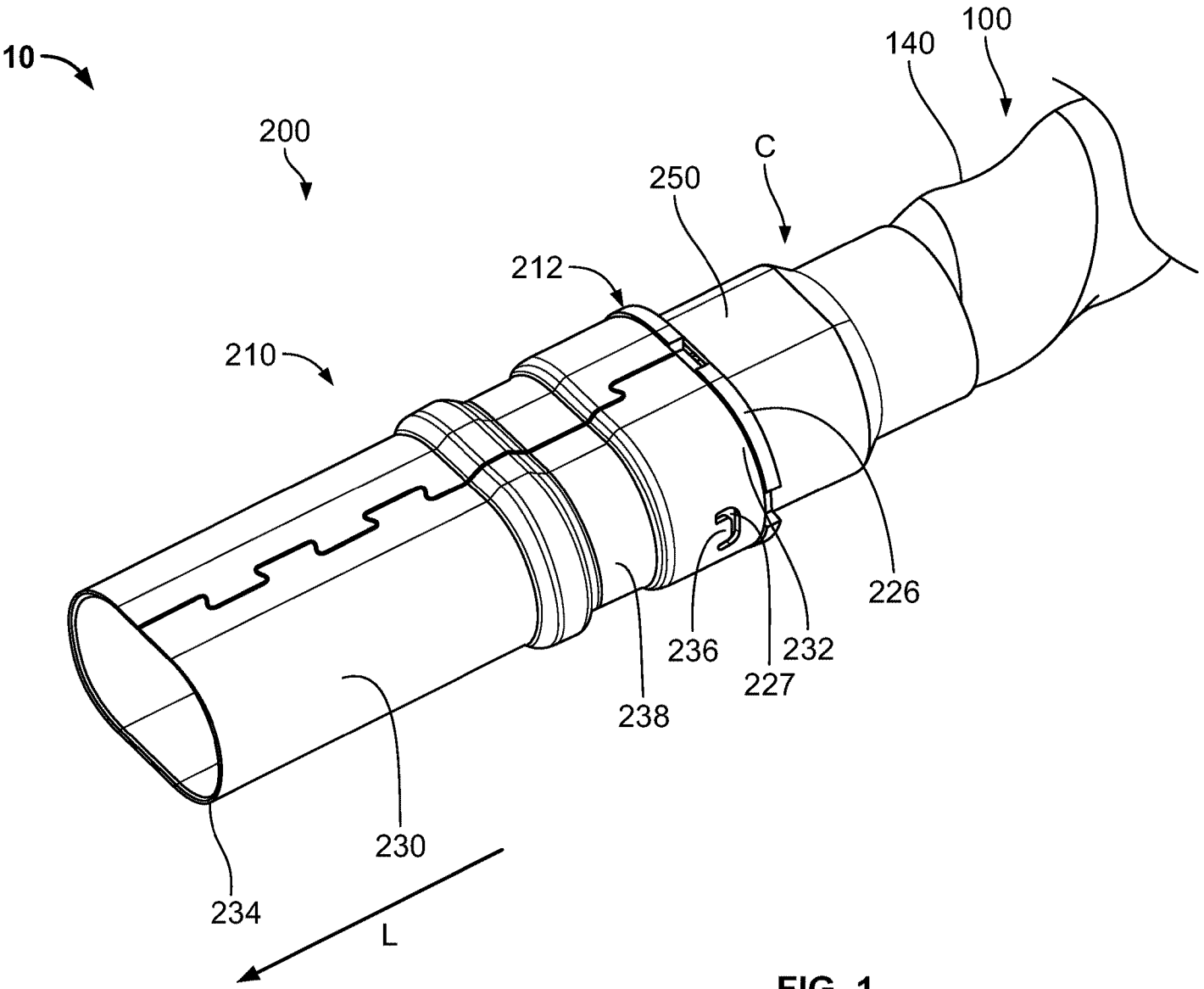
FIG. 1 is a perspective view of a cable harness assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

A cable harness assembly 10 according to an embodiment, as shown in FIG. 1, comprises a cable 100 and a connector assembly 200 connected to the cable 100. In the exemplary embodiment described herein, the cable harness assembly 10 is a plug and the connector assembly 200 is a plug connector assembly. In other embodiments, the cable harness assembly 10 may be a receptacle and the connector assembly 200 may be a receptacle connector assembly; the principles of the present disclosure apply to both plug and receptacle arrangements.

Figure 2:
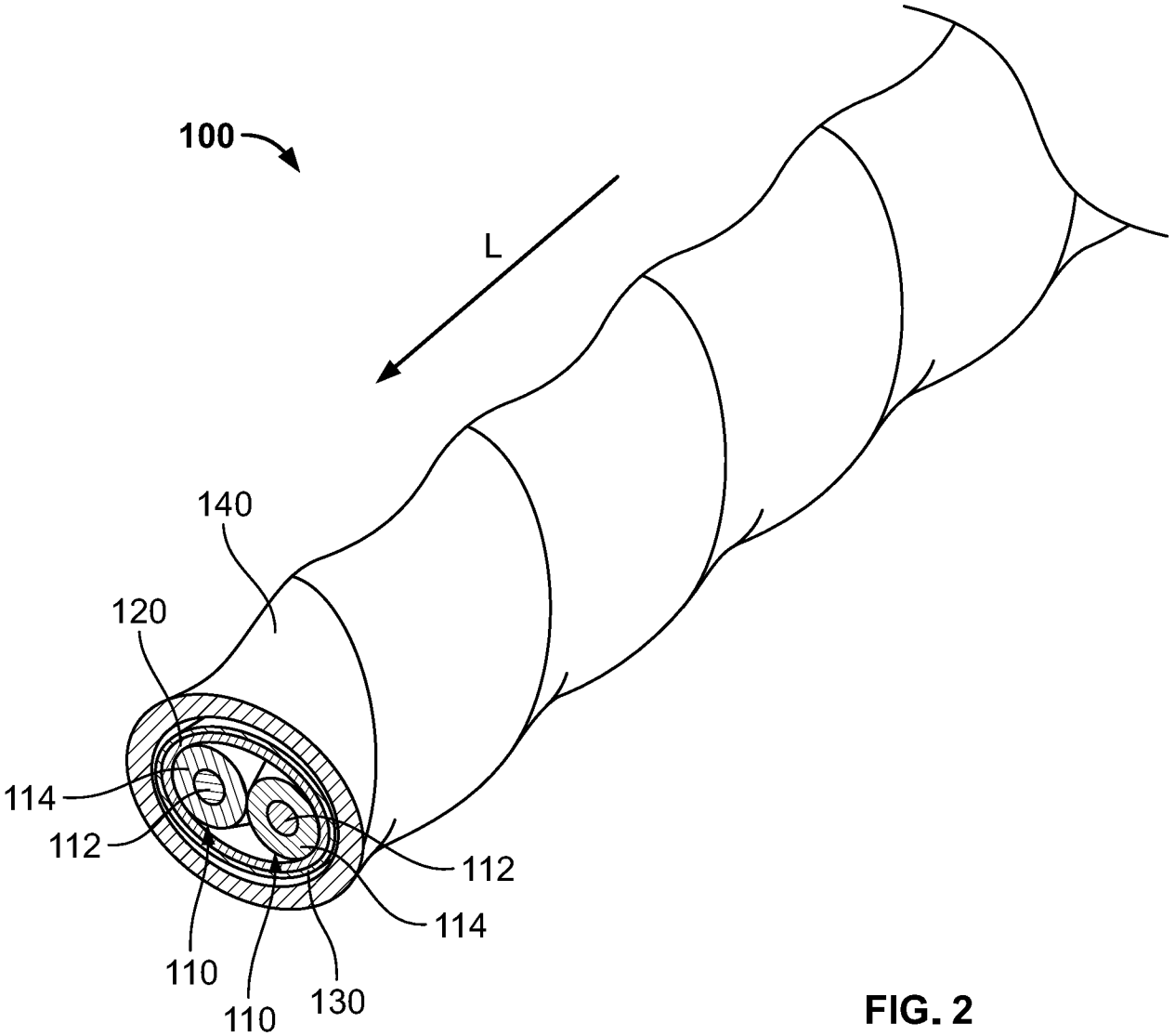
FIG. 2 is a perspective view of a cable of the cable harness assembly.

The cable 100, as shown in FIGS. 1 and 2, is a shielded twisted pair (STP) cable. The cable 100 includes a pair of wires 110 twisted around one another in a helix shape along a longitudinal direction L, a braided shield 130 disposed around and surrounding the pair of wires 110, and an outer insulative jacket 140 disposed around and surrounding the braided shield 130. In the shown embodiment, an inner insulative jacket 120 is disposed around and surrounding the pair of wires 110, and the braided shield 130 is disposed around and surrounding the inner insulative jacket 120. In another embodiment, the inner insulative jacket 120 may be omitted. In another embodiment, the cable 100 may include a foil wrapping disposed under the braided shield 130, around and surrounding the pair of wires 110.

Each of the wires 110, as shown in FIG. 2, has a conductor 112 and an insulation 114 disposed around and surrounding the conductor 112. The conductor 112 of each of the wires 110 and the braided shield 130 are formed of a conductive material, such as copper, aluminum, or other conductive materials used in electrical cables. The insulation 114 of each of the wires 110, the inner insulative jacket 120, and the outer insulative jacket 140 are each formed of an insulative material, such as rubber, polyethylene, silicon, or other forms of insulation used with conductive wires.

Figure 3:
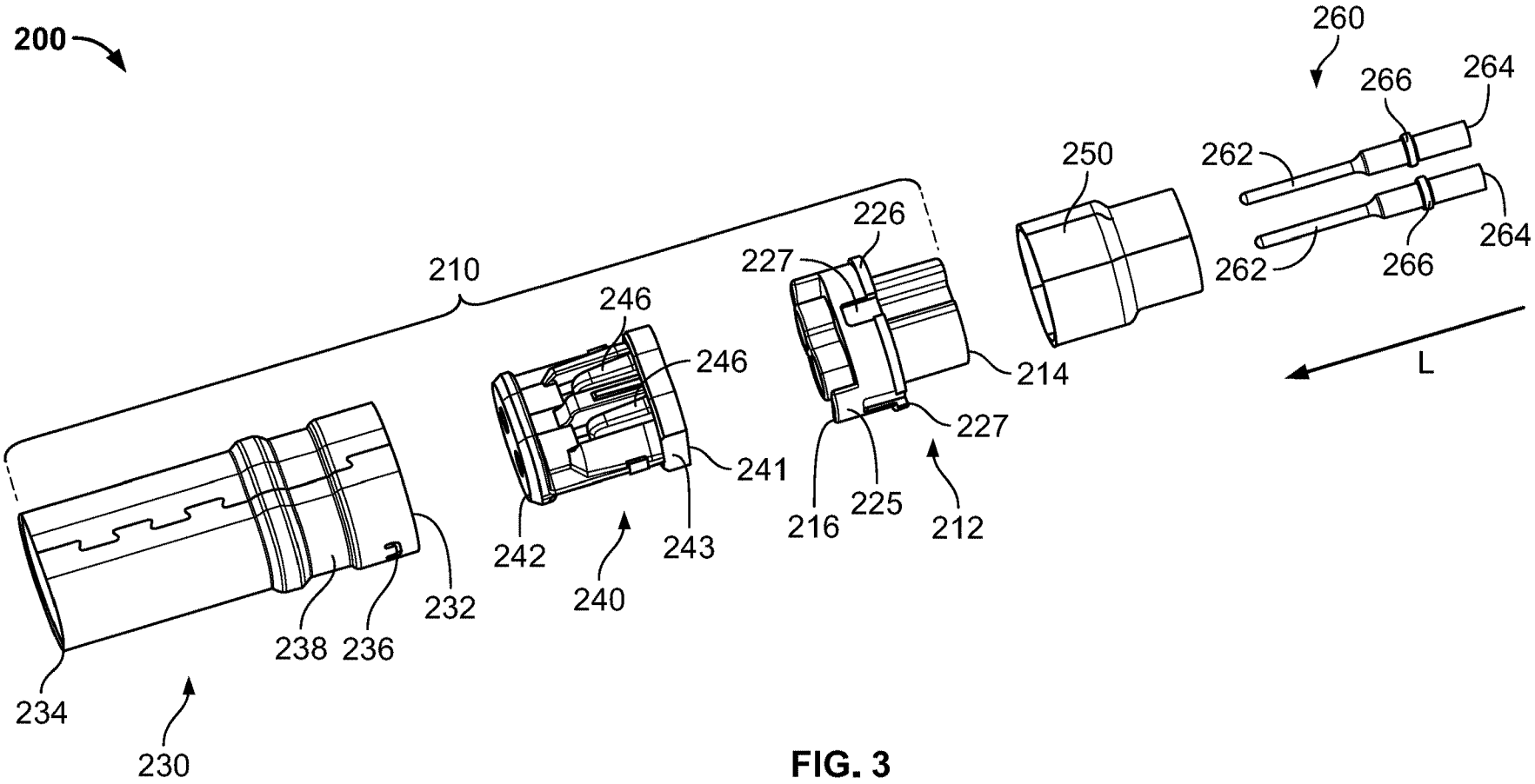
FIG. 3 is an exploded perspective view of a connector assembly of the cable harness assembly.

The connector assembly 200, as shown in FIGS. 1 and 3, includes a connector 210, an outer ferrule 250 disposed around a portion of the connector 210, and a pair of inner contacts 260 disposed within the connector 210.

The connector 210, as shown in FIG. 3, includes an inner ferrule 212, an outer contact 230 attachable to the inner ferrule 212, and a housing 240 attachable to the inner ferrule 212 and the outer contact 230. A first embodiment of the inner ferrule 212 is shown in FIGS. 3, 4A, and 4B, and a second embodiment of the inner ferrule 212 is shown in FIGS. 5A and 5B.

Figure 4A:
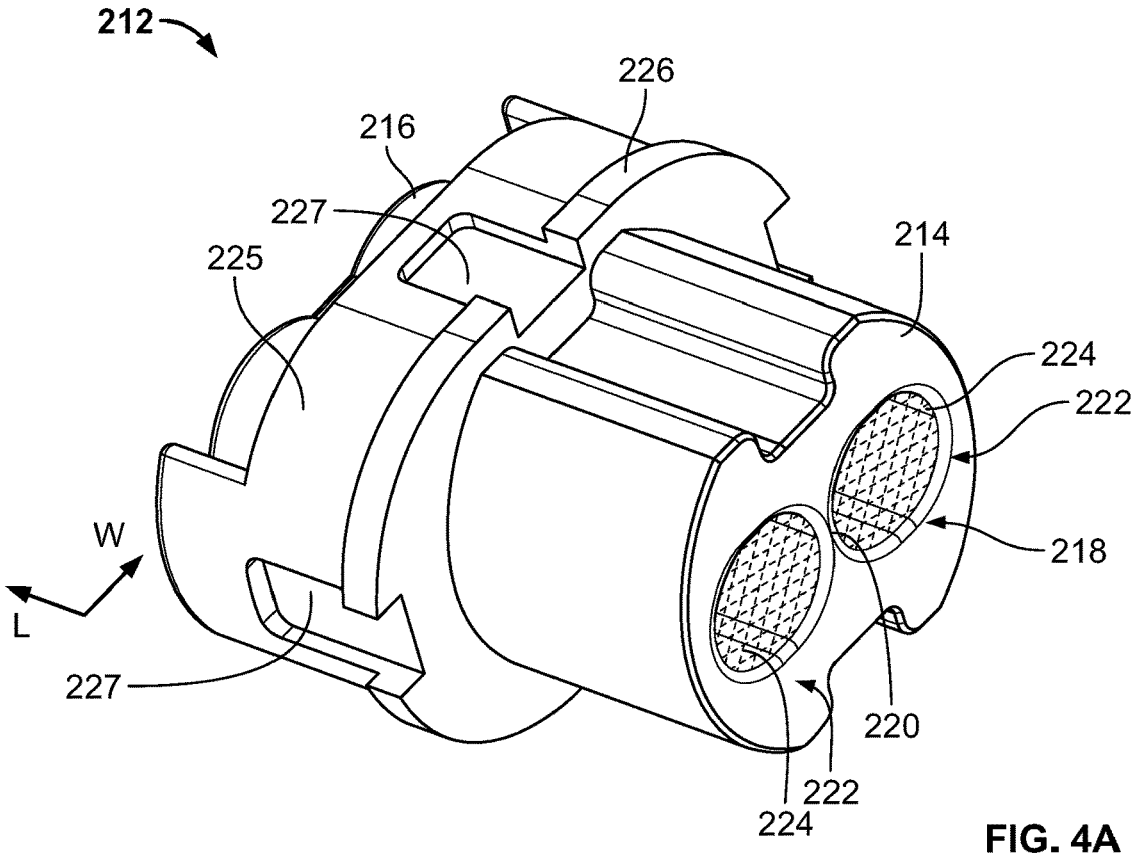
FIG. 4A is a perspective view of an inner ferrule of the connector assembly according to an embodiment.
Figure 4B:
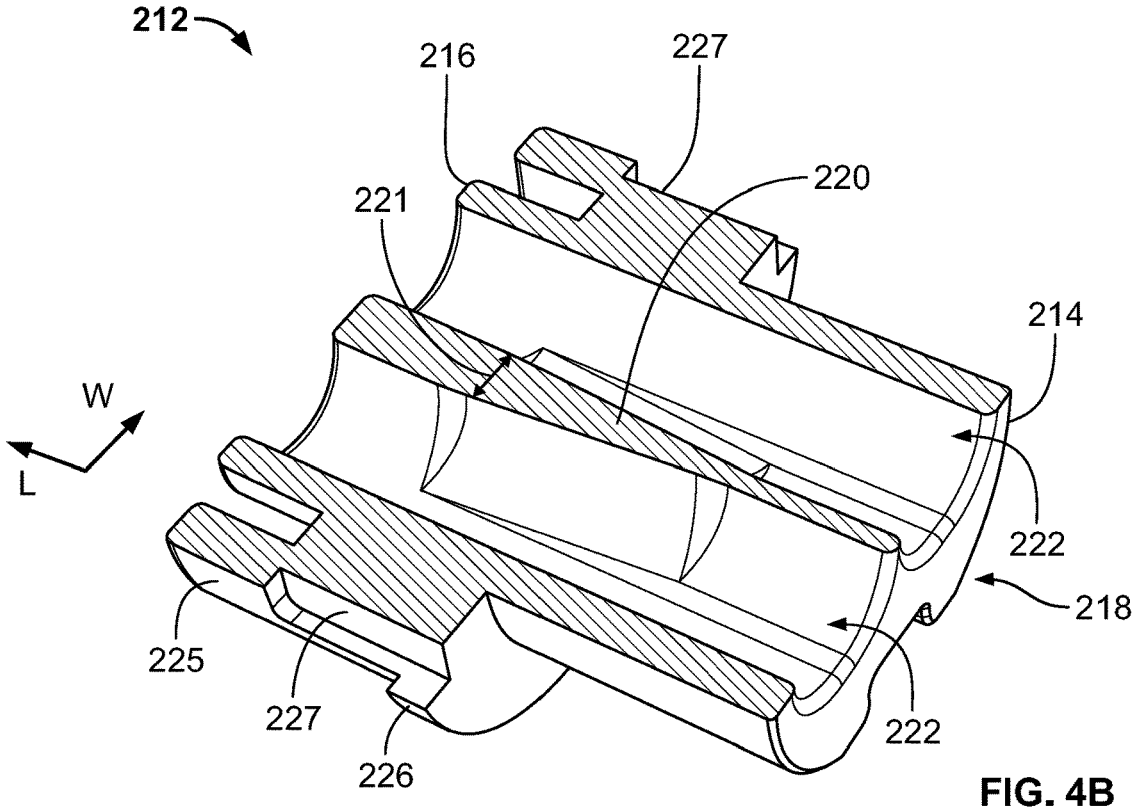
FIG. 4B is a sectional perspective view of the inner ferrule of FIG. 4A.
Figure 5A:
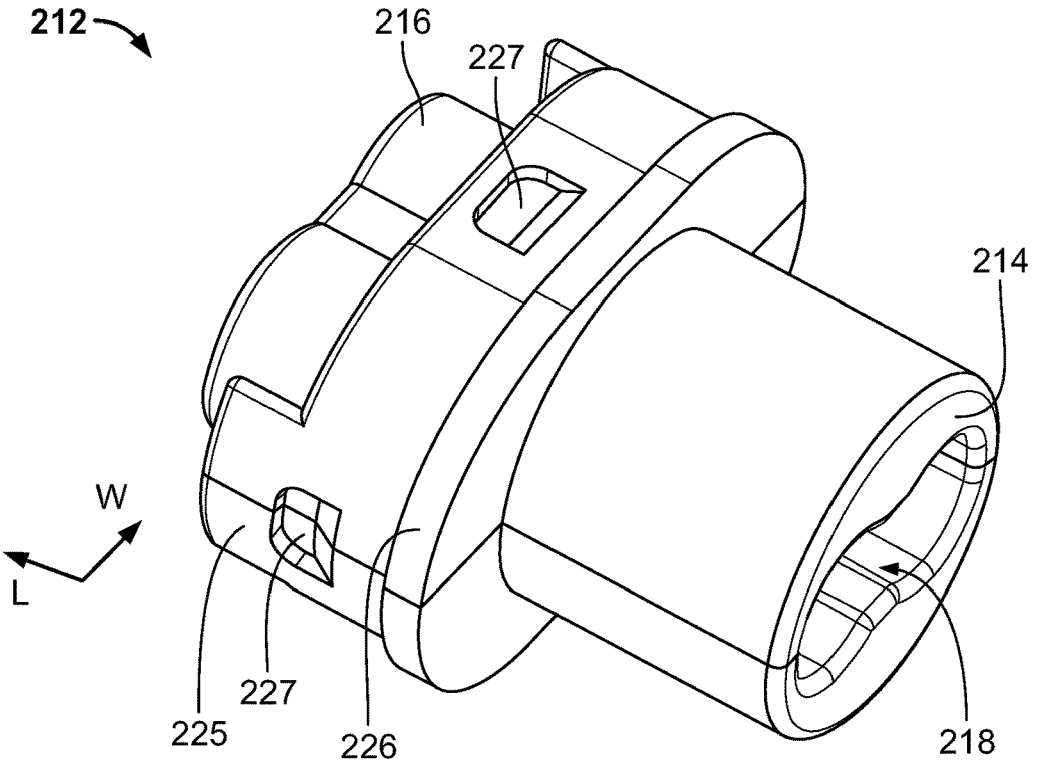
FIG. 5A is a perspective view of an inner ferrule of the connector assembly according to another embodiment.
Figure 5B:
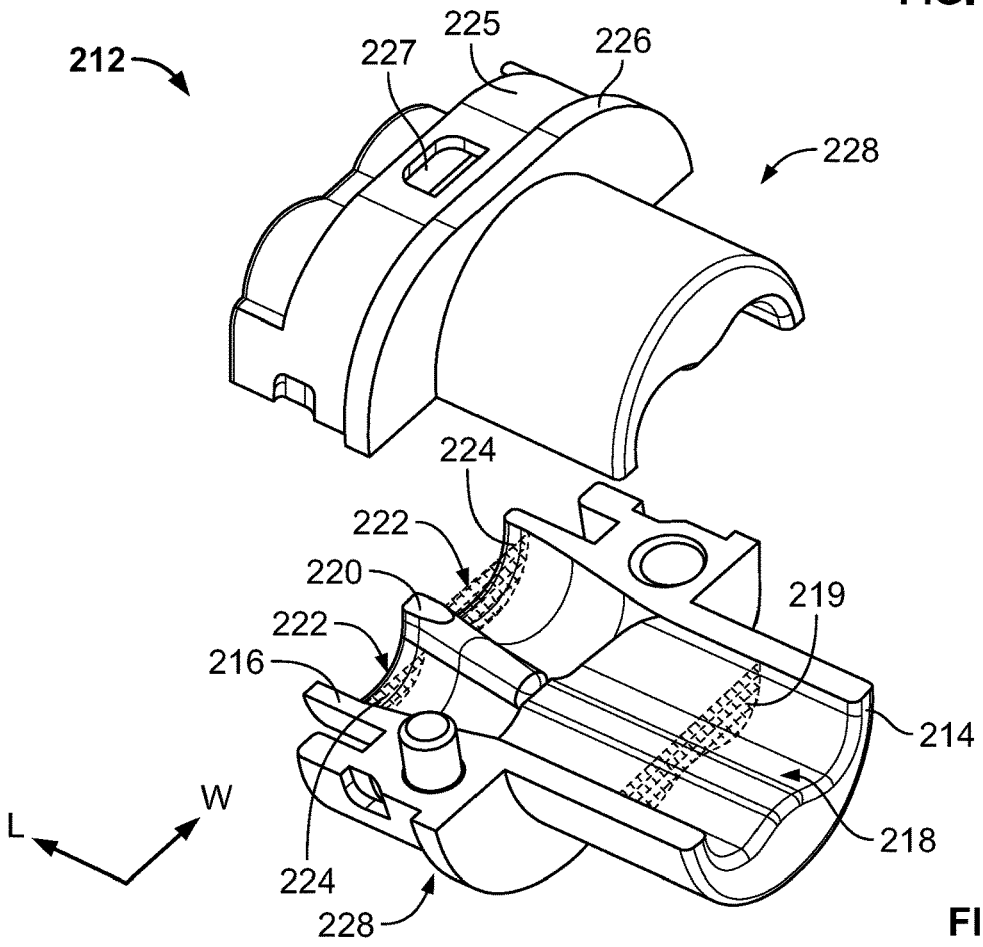
FIG. 5B is an exploded perspective view of the inner ferrule of FIG. 5A.

The inner ferrule 212, as shown in the embodiment of FIGS. 3, 4A, and 4B, has a first end 214 and a second end 216 opposite the first end 214 in the longitudinal direction L. The inner ferrule 212 has a cable passageway 218 extending through the inner ferrule 212 in the longitudinal direction L from the first end 214 to the second end 216. A separator 220 disposed in the cable passageway 218 separates the cable passageway 218 into a pair of individual wire passageways 222. In the embodiment shown in FIGS. 3, 4A, and 4B, the inner ferrule 212 is monolithically formed in a single piece from a conductive material.

In the embodiment shown in FIGS. 3, 4A, and 4B, the separator 220 extends along an entirety of the cable passageway 218 from the first end 214 to the second end 216. The separator 220 has a thickness 221 in a width direction W perpendicular to the longitudinal direction L. In the shown embodiment, the thickness 221 increases from the first end 214 to the second end 216; the thickness 221 is at a minimum at the first end 214 and is at a maximum at the second end 216. Due to the variation in the thickness 221 of the separator 220, a cross-sectional area 224 of each of the individual wire passageways 222 decreases from the first end 214 to the second end 216; the cross-sectional area 224 is at a maximum at the first end 214 and is at a minimum at the second end 216. In another embodiment, the thickness 221 is constant along the length of the separator 220 in the longitudinal direction L, and the cross-sectional area 224 of each of the individual wire passageways 222 is constant along the longitudinal direction L. The individual wire passageways 222 are identical in the shown embodiment and have identical cross-sectional areas 224.

The inner ferrule 212, as shown in the embodiment of FIGS. 3, 4A, and 4B, has an exterior surface 225 extending around the cable passageway 218. The exterior surface 225 has a stop 226 protruding from the exterior surface 225 and a plurality of indents 227 extending into the exterior surface 225.

An inner ferrule 212 according to another embodiment is shown in FIGS. 5A and 5B. Like reference numbers indicate like elements with respect to the embodiment shown in FIGS. 4A and 4B and only the differences of the embodiment shown in FIGS. 5A and 5B will be described in detail herein.

In the embodiment shown in FIGS. 5A and 5B, instead of the separator 220 extending along the entirety of cable passageway 218 from the first end 214 to the second end 216, the separator 220 is disposed only at the second end 216 of the inner ferrule 212. The cable passageway 218 in the embodiment shown in FIGS. 5A and 5B is not separated into the individual wire passageways 222 at the first end 214, but rather is separated into the individual wire passageways 222 at a point along the longitudinal direction L close to the second end 216. The cable passageway 218 has a cross-sectional area 219 at the first end 214 that is larger than the cross-sectional area 224 of each of the individual wire passageways 222 at the second end 216.

In the embodiment shown in FIGS. 5A and 5B, instead of being monolithically formed in a single piece, the inner ferrule 212 is formed in a pair of halves 228 that are attachable to one another or matable together. Each of the halves 228, as shown in FIG. 5B, is monolithically formed in a single piece of a conductive material and has a portion of the cable passageway 218, a portion of the separator 220, and a portion of each of the individual wire passageways 222. In the shown embodiment, the halves 228 are identical to one another. Attachment of the halves 228, as shown in FIG. 5A, forms the assembled inner ferrule 212.

The features of the aforementioned embodiments of the inner ferrule 212 shown in FIGS. 4A-5B are interchangeable and combinable. For example, in another embodiment, the inner ferrule 212 may be monolithically formed in a single piece as in the embodiment of FIGS. 4A and 4B, instead of the pair of halves 228 of the embodiment of FIGS. 5A and 5B, yet may have the separator 220 disposed only at the second end 216 as in the embodiment of FIGS. 5A and 5B.

The outer contact 230, as shown in FIGS. 1 and 3, has a first end 232 and a second end 234 opposite the first end 232 in the longitudinal direction L. The outer contact 230 is formed of a conductive material and, in the shown embodiment, is formed by stamping and bending a single metal sheet into an approximately cylindrical shape. The outer contact 230 has a plurality of tabs 236 proximal to the first end 232 and a step 238 between the first end 232 and the second end 234. The tabs 236 and the step 238, in an embodiment, are formed by stamping. The step 238 is a portion of the outer contact 230 that is narrowed with respect to the first end 232.

Figure 6:
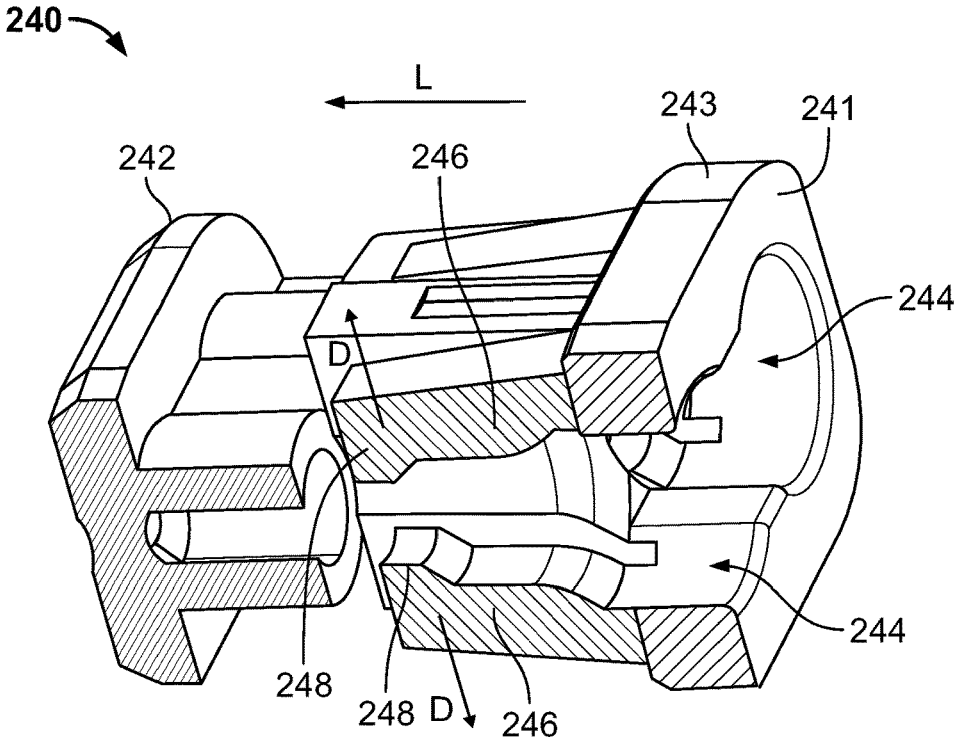
FIG. 6 is a sectional perspective view of a housing of the connector.

The housing 240, as shown in FIGS. 3 and 6, has a first end 241 and a second end 242 opposite the first end 241 in the longitudinal direction L. The housing 240 has a flange 243 at the first end 241 that forms a maximum outer dimension of the housing 240. The housing 240 has a pair of terminal receiving passageways 244 extending through the housing 240 from the first end 241 to the second end 242.

Each of the terminal receiving passageways 244, in the embodiment shown in FIG. 6, has a pair of opposite terminal retention latches 246 extending from the flange 243 into the terminal receiving passageway 244. The terminal retention latches 246 are each formed as a cantilever with a fixed end at the flange 243 and are elastically deflectable along a deflection axis D perpendicular to the longitudinal direction L. Each of the terminal retention latches 246 has a latch protrusion 248 at a free end opposite the flange 243. In other embodiments, each of the terminal receiving passageways 244 may only have one terminal retention latch 246 or may have a plurality of terminal retention latches 246 that are not opposite one another. In other embodiments, the terminal retention latches 246 may be components separate from the housing 240.

In the shown embodiment, the housing 240 is monolithically formed in a single piece from an insulative material. In other embodiments, the components of the housing 240 described above may be formed separately and assembled together.

The outer ferrule 250 is monolithically formed in a single piece from a conductive material. The outer ferrule 250 is shown in a crimped state C in FIG. 1 and an uncrimped state U in FIGS. 7, 8, and 10. In the embodiment shown in FIGS. 7, 8, and 10 the outer ferrule 250 is a cylindrical element 252 in the uncrimped state U. In other embodiments, the outer ferrule 250 may be a stepped extruded element or a flared element in the uncrimped state U.

Figure 8:
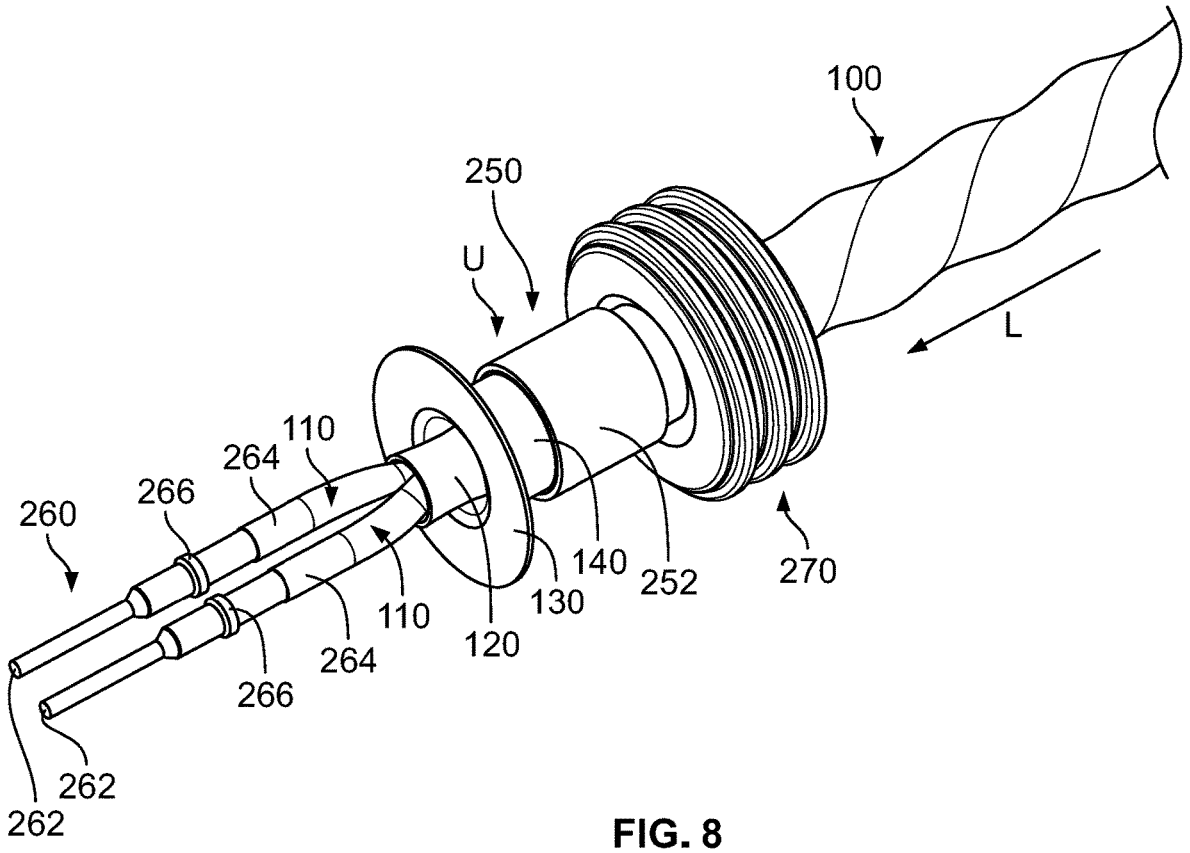
FIG. 8 is a perspective view of the cable with a pair of inner contacts.

The inner contacts 260 of the connector assembly 200, as shown in FIGS. 3 and 8, each have a pin section 262 and a crimp section 264 opposite the pin section 262 in the longitudinal direction L. The inner contacts 260 are each formed of a conductive material, such as copper, that is solid in the pin section 262 and hollow in the crimp section 264. The inner contacts 260 each have a shoulder 266 protruding outward and circumferentially around the inner contact 260 between the pin section 262 and the crimp section 264. In the shown embodiment, the inner contacts 260 are each monolithically formed in a single piece. In other embodiments, the components of the inner contacts 260 described herein may be formed separately and assembled together. In other embodiments, the inner contacts 260 may each have a socket section in place of the pin section 262.

A process of assembling the cable harness assembly 10 will now be described in greater detail primarily with reference to FIGS. 7-11.

Figure 7:
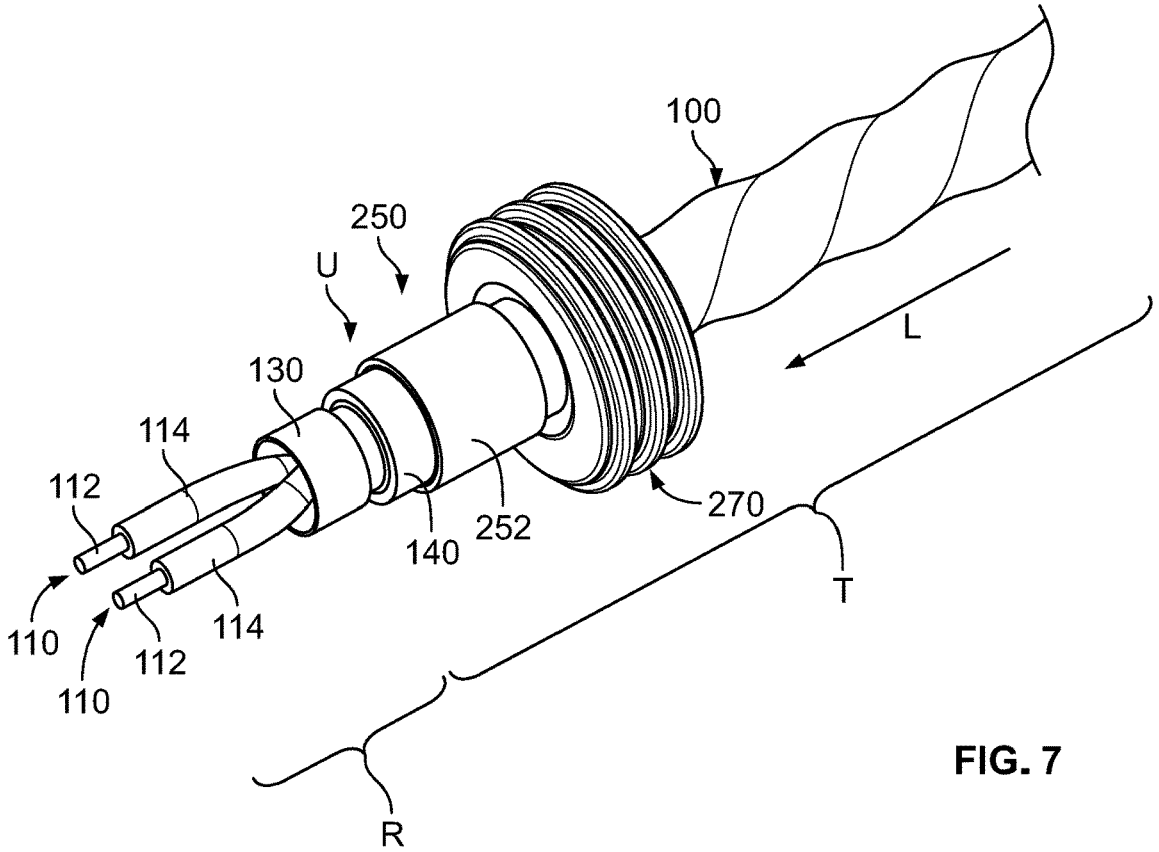
FIG. 7 is a perspective view of the cable with an outer ferrule and a seal.

As shown in FIG. 7, the cable 100 is prepared. From the state shown in FIG. 2, a portion of the outer insulative jacket 140 is stripped to expose the braided shield 130, a portion of the braided shield 130 is stripped to expose the pair of wires 110, and a portion of the insulation 114 of each of the pair of wires 110 is stripped to expose the conductor 112 of each of the wires 110. As an STP cable 100, the wires 110 are twisted around one another in the helix shape along the longitudinal direction L in a twisted region T. At an end of the cable 100 at which the conductors 112 are exposed, the wires 110 are separated from one another to form an untwisted region R.

As shown in the embodiment of FIG. 7, the outer ferrule 250 in the uncrimped state U is slid over the outer insulative jacket 140 in the longitudinal direction L and is positioned around the outer insulative jacket 140. The outer ferrule 250 can be slid over the outer insulative jacket 140 either before or after the cable 100 is stripped.

In the embodiment shown in FIG. 7, the cable harness assembly 10 includes a seal 270 that is also slid over the outer insulative jacket 140 in the longitudinal direction L and is positioned around the outer insulative jacket 140. The seal 270 may be formed of an elastomeric material that can be deflected to seal between an outer surface of the outer insulative jacket 140 and, for example, a further housing (not shown) of the cable harness assembly 10. The seal 270 is slid over the outer insulative jacket 140 before the outer ferrule 250, but can be slid over the outer insulative jacket 140 before or after the cable 100 is stripped.

After the cable 100 is stripped and the outer ferrule 250 and the seal 270 are disposed over the outer insulative jacket 140, the inner contacts 260 are electrically connected and secured to the conductors 112 of the wires 110 as shown in FIG. 8. In the embodiment shown in FIG. 8, the crimp section 264 of each of the inner contacts 260 is crimped to one of the conductors 112. In other embodiments, the inner contacts 260 could be secured and electrically connected to the conductors 112 by other forms of connection, such as a press-fit or a soldered connection. As shown in FIG. 8, the portion of the braided shield 130 exposed from the outer insulative jacket 140 is flared.

Figure 9:
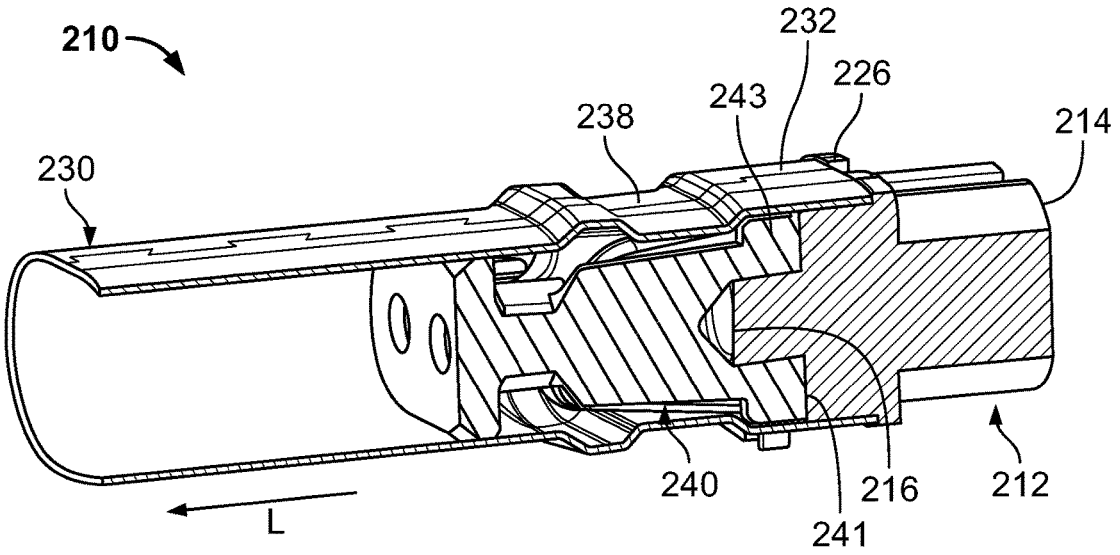
FIG. 9 is a sectional perspective view of a connector of the cable harness assembly including the inner ferrule, the housing, and an outer contact.

Before or after the preparation of the cable 100 shown in FIGS. 7 and 8, the connector 210 of the connector assembly 200 is assembled as shown in FIG. 9. From the state shown in FIG. 3, the first end 241 of the housing 240 is inserted over the second end 216 of the inner ferrule 212 as shown in FIG. 9. The outer contact 230 is then inserted in the longitudinal direction L over the housing 240 until the first end 232 of the outer contact 230 contacts the stop 226 of the inner ferrule 212.

Figure 10:
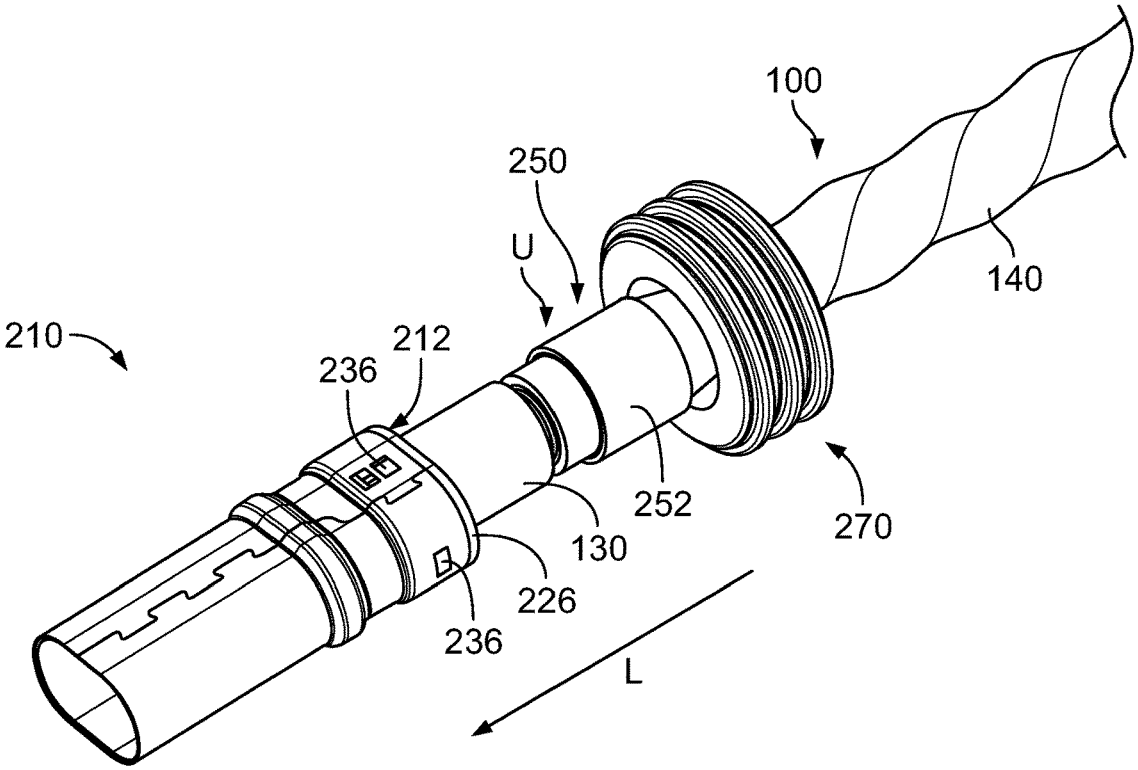
FIG. 10 is a perspective view of the cable attached to the connector.

The tabs 236, in the embodiment shown in FIGS. 1 and 10, are bent into engagement with the indents 227 on the exterior surface 225 of the inner ferrule 212, attaching the outer contact 230 to the inner ferrule 212. In another embodiment, the tabs 236 are bent prior to insertion of the outer contact 230 over the housing 240 and the inner ferrule 212, elastically deflecting during the insertion and elastically engaging the indents 227.

The outer contact 230 and the inner ferrule 212 are electrically connected to one another in the assembled state of the connector 210 shown in FIG. 9. As shown in FIG. 9, the flange 243 is positioned between the step 238 of the outer contact 230 and the inner ferrule 212 with the outer contact 230 attached to the inner ferrule 212. The step 238 holds the housing 240 in place on the second end 216 of the inner ferrule 212.

In the assembled state shown in FIG. 9, the inner ferrule 212, the outer contact 230, and the housing 240 are attachable together to form the connector 210 as an independent element. The connector 210 is attached and secured together independently of any attachment to other elements, such as the cable 100. The assembled state shown in FIG. 9 and the attachment described above applies for both the embodiment of the inner ferrule 212 shown in FIGS. 4A and 4B and the embodiment of the inner ferrule 212 shown in FIGS. 5A and 5B.

Figure 11:
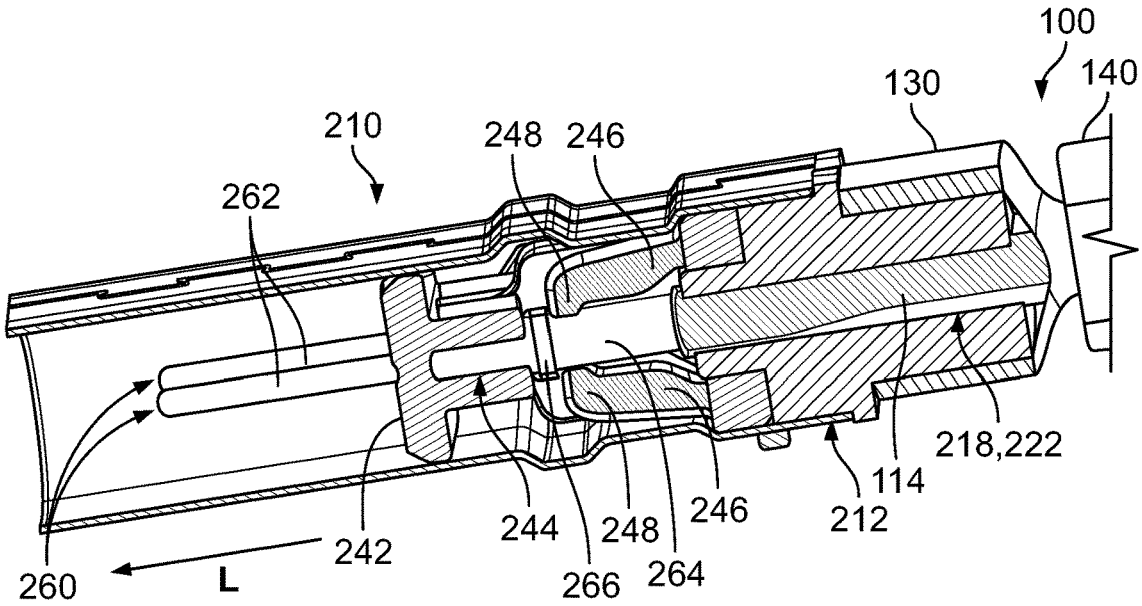
FIG. 11 is a sectional side perspective view of the cable attached to the connector.
Figure 12:
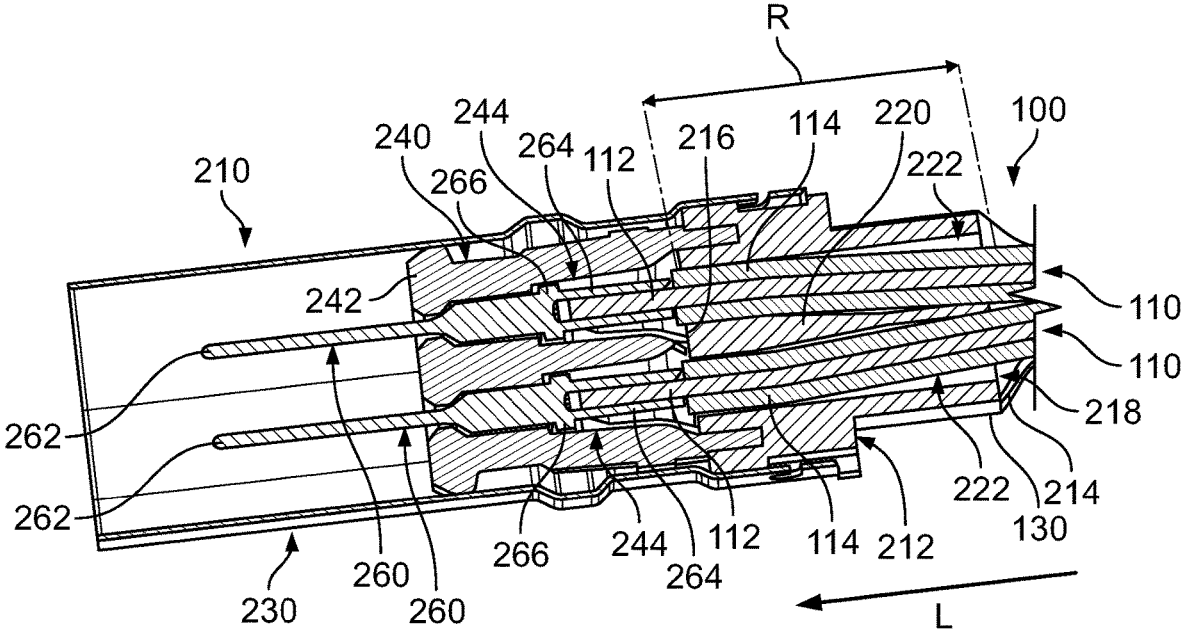
FIG. 12 is a sectional top perspective view of the cable attached to the connector.

With the connector 210 in the assembled state shown in FIG. 9 and the cable 100 prepared as shown in FIG. 8, the cable 100 with the crimped inner contacts 260 is inserted into the connector 210 along the longitudinal direction L as shown in FIGS. 10-12.

As shown in FIGS. 11 and 12, the inner contacts 260 are inserted through the cable passageway 218, including the individual wire passageways 222, of the inner ferrule 212 and into the terminal receiving passageways 244 of the housing 240. Each of the inner contacts 260 is positioned in one of the terminal receiving passageways 244. Each of the inner contacts 260 is inserted into one of the terminal receiving passageways 244 until the shoulder 266 contacts the terminal retention latches 246 and deflects the terminal retention latches 246 outward along the deflection axis D as shown in FIG. 6. As the inner contacts 260 continue to move along the longitudinal direction L, the shoulder 266 passes the latch protrusion 248 of each of the terminal retention latches 246, and the terminal retention latches 246 elastically return along the deflection axis D to the position shown in FIG. 11.

As shown in FIG. 11, each of the inner contacts 260 is held in one of the terminal receiving passageways 244 with the latch protrusion 248 abutting a side of the shoulder 266 in the longitudinal direction L. The inner contacts 260 simultaneously engage the terminal retention latches 246 to secure the cable 100 to the housing 240 and within the inner ferrule 212. The crimp section 264 is positioned between the terminal retention latches 246 and the pin section 262 protrudes from the front end 242 of the housing 240. As the inner contacts 260 are held within the connector 210 by the terminal retention latches 246, and the crimp section 264 of each of the inner contacts 260 is crimped to one of the conductors 112 as shown in FIG. 12, the securing of the inner contacts 260 in the connector 210 also secures the cable 100 to the connector 210 prior to crimping of the outer ferrule 250 described below. This initial securing of the cable 100 to the connector 210 eases manufacturability and serviceability of the cable harness assembly 10.

As shown in FIG. 12, when the inner contacts 260 are fully inserted into the terminal receiving passageways 244, the untwisted region R of the wires 110 is disposed in the inner ferrule 212. The separator 220 is disposed between the wires 110 in the untwisted region R and each of the wires 110 is disposed in one of the individual wire passageways 222. The inner ferrule 212 surrounds the cable 100 in the untwisted region R, and the inner ferrule 212 with the separator 220 individually surrounds each of the wires 110 at least at the second end 216 of the inner ferrule 212. In the embodiment of the inner ferrule 212 shown in FIG. 12, which is the inner ferule 212 of FIGS. 4A and 4B, the inner ferrule 212 with the separator 220 individually surrounds each of the wires 110 from an entirety of the first end 214 to the second end 216 of each of the wires 110 along the longitudinal direction L. The separator 220 and the surrounding of the wires 110 with the inner ferrule 212 improves control of an impedance in the untwisted region R.

With the cable 100 and the inner contacts 260 latched to the connector 210, the braided shield 130 that was flared as shown in FIG. 8 is positioned around the inner ferrule 212, as shown in FIGS. 10-12.

In the embodiment shown in FIG. 10, with the braided shield 130 positioned around the inner ferrule 212, the outer ferrule 250 formed as the cylindrical element 252 is slid along the longitudinal direction L over the braided shield 130 into abutment with the stop 226. The outer ferrule 250 is crimped around the braided shield 130 and the inner ferrule 212 to the crimped state C shown in FIG. 1, further securing the braided shield 130 and the cable 100 to the inner ferrule 212. The braided shield 130 is held between the inner ferrule 212 and the outer ferrule 250 and is electrically connected to the inner ferrule 212.

Figure 13:
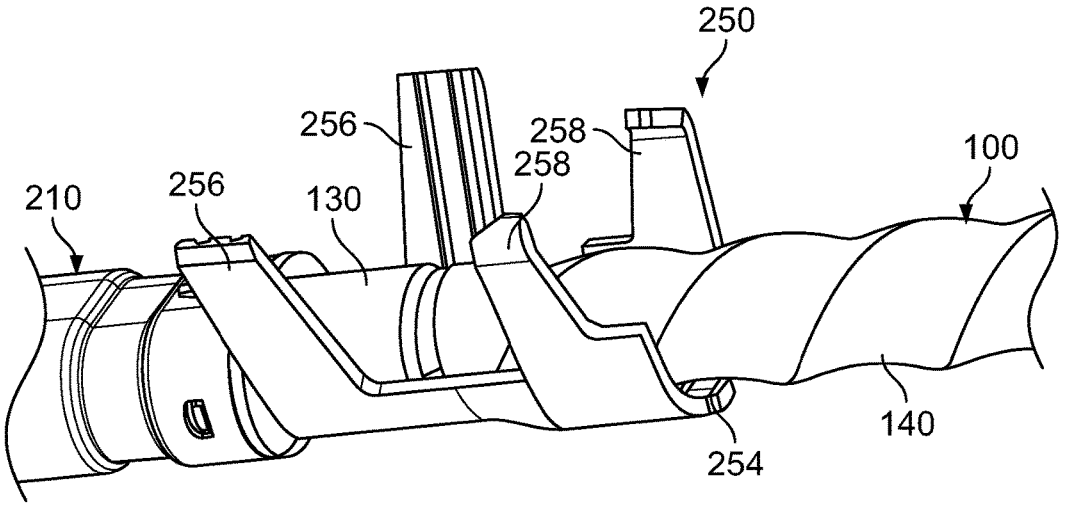
FIG. 13 is a perspective view of the cable attached to the connector with an outer ferrule according to another embodiment.

An outer ferrule 250 according to another embodiment, as shown in FIG. 13, includes a base 254, a pair of conductor crimp wings 256 extending from opposite sides of the base 254, and a pair of insulation crimp wings 258 extending from opposite sides of the base 254. The outer ferrule 250 in the embodiment of FIG. 13 is monolithically formed in a single piece from a conductive material.

The outer ferrule 250 in the embodiment of FIG. 13, contrary to the outer ferrule 250 of the embodiment of FIG. 10, does not need to be slid over the outer insulative jacket 140 prior to attachment of the cable 100 to the connector 210. Instead, with the cable 100 and the inner contacts 260 latched to the connector 210 and the braided shield 130 positioned around the inner ferrule 212, the outer ferrule 250 of FIG. 13 can be then moved into position and crimped, which eases manufacturability and serviceability of the cable harness assembly 10. The conductor crimp wings 256 are crimped around the braided shield 130 and the inner ferrule 212 to hold the braided shield 130 between the inner ferrule 212 and the outer ferrule 250. The insulation crimp wings 258 are crimped around the outer insulative jacket 140 to further secure the outer ferrule 250 to the cable 100 and the connector 210.

What is claimed is:

1. A cable harness assembly, comprising:

a cable having a pair of wires, each of the wires having a conductor and an insulation disposed around the conductor, the pair of wires have a twisted region and an untwisted region; and a connector assembly including an inner ferrule formed of a conductive material, the inner ferrule having a cable passageway extending through the inner ferrule and a separator disposed within the cable passageway, the untwisted region is disposed in the inner ferrule and the separator is disposed between the wires in the untwisted region, the inner ferrule with the separator individually surrounds each of the wires in the untwisted region.

2. The cable harness assembly of claim 1, wherein the inner ferrule has a first end and a second end, the separator is positioned at the second end and separates the cable passageway into a pair of individual wire passageways, each of the wires is disposed in one of the individual wire passageways.

3. The cable harness assembly of claim 2, wherein the separator extends from the first end of the inner ferrule to the second end of the inner ferrule.

4. The cable harness assembly of claim 2, wherein each of the individual wire passageways at the second end has a cross-sectional area smaller than the cable passageway at the first end.

5. The cable harness assembly of claim 1, wherein the inner ferrule is monolithically formed in a single piece or in a pair of halves attachable to one another.

6. The cable harness assembly of claim 1, wherein the connector assembly includes an outer ferrule crimped over the inner ferrule.

7. The cable harness assembly of claim 6, wherein the cable has a braided shield disposed around the pair of wires, the braided shield is held between the inner ferrule and the outer ferrule.

8. The cable harness assembly of claim 7, wherein the cable has an outer insulative jacket disposed around the braided shield, the outer ferrule is positionable around the outer insulative jacket in an uncrimped state.

9. The cable harness assembly of claim 7, wherein the outer ferrule has a base and a pair of conductor crimp wings extending from the base, the conductor crimp wings are crimped around the braided shield and the inner ferrule.

10. The cable harness assembly of claim 9, wherein the cable has an outer insulative jacket disposed around the braided shield and the outer ferrule has a pair of insulation crimp wings extending from the base, the insulation crimp wings are crimped around the outer insulative jacket.

11. The cable harness assembly of claim 1, wherein the connector assembly includes a housing formed of an insulative material and attached to the inner ferrule.

12. The cable harness assembly of claim 11, wherein the connector assembly includes a pair of inner contacts, each of the inner contacts is crimped to the conductor of one of the wires, the inner contacts are inserted through the inner ferrule into the housing.

13. The cable harness assembly of claim 12, wherein the housing has a plurality of terminal retention latches, the inner contacts simultaneously engage the terminal retention latches to secure the cable to the housing and within the inner ferrule.

14. The cable harness assembly of claim 11, wherein the connector assembly includes an outer contact formed of a conductive material and attached to the inner ferrule, the inner ferrule, the housing, and the outer contact are attachable together to form a connector independent of the cable.

15. A method of assembling a cable harness assembly, comprising:

providing a cable having a pair of wires and a braided shield disposed around the pair of wires, each of the wires having a conductor, an insulation disposed around the conductor, and an inner contact crimped to the conductor, the pair of wires have a twisted region and an untwisted region;

providing a connector including an inner ferrule attached to a housing, the housing having a plurality of terminal retention latches;

inserting the inner contact of each of the wires through the inner ferrule into the housing, the inner contacts simultaneously engage the terminal retention latches to secure the cable to the housing and the untwisted region within the inner ferrule; and crimping an outer ferrule around the braided shield and the inner ferrule, the braided shield is held between the inner ferrule and the outer ferrule.

16. The method of claim 15, further comprising, prior to the inserting and crimping steps, sliding the outer ferrule over an outer insulative jacket of the cable disposed around the braided shield.

17. The method of claim 15, wherein the outer ferrule has a base and a pair of conductor crimp wings extending from the base, the conductor crimp wings are positioned around the braided shield and the inner ferrule and crimped in the crimping step after the inserting step.

18. The method of claim 15, wherein the connector includes an outer contact attached to the inner ferrule, the inner ferrule, the housing, and the outer contact are attachable together to form the connector prior to the inserting step.

19. The method of claim 15, wherein the inner ferrule has a cable passageway extending into a first end of the inner ferrule and a separator disposed within the cable passageway, the separator is disposed between the wires in the untwisted region.

20. A cable harness assembly, comprising:

a cable having a pair of wires, each of the wires having a conductor and a insulation disposed around the conductor, the pair of wires have a twisted region and an untwisted region; and a connector assembly including an inner ferrule formed of a conductive material and an outer ferrule crimped over the inner ferrule, the inner ferrule having a cable passageway extending through the inner ferrule and a separator disposed within the cable passageway, the untwisted region is disposed in the inner ferrule and the separator is disposed between the wires in the untwisted region.

21. The cable harness assembly of claim 20, wherein the cable has a braided shield disposed around the pair of wires, the braided shield is held between the inner ferrule and the outer ferrule.

22. The cable harness assembly of claim 21, wherein the cable has an outer insulative jacket disposed around the braided shield, the outer ferrule is positionable around the outer insulative jacket in an uncrimped state.

23. The cable harness assembly of claim 21, wherein the outer ferrule has a base and a pair of conductor crimp wings extending from the base, the conductor crimp wings are crimped around the braided shield and the inner ferrule.

24. The cable harness assembly of claim 23, wherein the cable has an outer insulative jacket disposed around the braided shield and the outer ferrule has a pair of insulation crimp wings extending from the base, the insulation crimp wings are crimped around the outer insulative jacket.

25. A cable harness assembly, comprising:

a cable having a pair of wires, each of the wires having a conductor and a insulation disposed around the conductor, the pair of wires have a twisted region and an untwisted region; and a connector assembly including an inner ferrule formed of a conductive material and a housing formed of an insulative material and attached to the inner ferrule, the inner ferrule having a cable passageway extending through the inner ferrule and a separator disposed within the cable passageway, the untwisted region is disposed in the inner ferrule and the separator is disposed between the wires in the untwisted region.

26. The cable harness assembly of claim 25, wherein the connector assembly includes a pair of inner contacts, each of the inner contacts is crimped to the conductor of one of the wires, the inner contacts are inserted through the inner ferrule into the housing.

27. The cable harness assembly of claim 26, wherein the housing has a plurality of terminal retention latches, the inner contacts simultaneously engage the terminal retention latches to secure the cable to the housing and within the inner ferrule.

28. The cable harness assembly of claim 25, wherein the connector assembly includes an outer contact formed of a conductive material and attached to the inner ferrule, the inner ferrule, the housing, and the outer contact are attachable together to form a connector independent of the cable.

29. A cable harness assembly, comprising:

a cable having a pair of wires, each of the wires having a conductor and a insulation disposed around the conductor, the pair of wires have a twisted region and an untwisted region; and a connector assembly including an inner ferrule formed of a conductive material, the inner ferrule having a cable passageway extending through the inner ferrule and a separator disposed within the cable passageway, the untwisted region is disposed in the inner ferrule and the separator is disposed between the wires in the untwisted region, the inner ferrule has a first end and a second end, the separator is positioned at the second end and separates the cable passageway into a pair of individual wire passageways, each of the wires is disposed in one of the individual wire passageways, the separator extends from the first end of the inner ferrule to the second end of the inner ferrule.

* * * * *